US006206206B1

(12) United States Patent
Saylor et al.

(10) Patent No.: US 6,206,206 B1
(45) Date of Patent: Mar. 27, 2001

(54) RAIL-MOUNTED HANGING FILE ARRANGEMENT

(75) Inventors: Charles Saylor, Grand Rapids; David Byrne, Jenison, both of MI (US); Sheldon Phillips, Thousand Oaks; Edward Mitchell, Los Angeles, both of CA (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/304,163

(22) Filed: Apr. 30, 1999

(51) Int. Cl.[7] ..... A47F 7/16

(52) U.S. Cl. ..... 211/46; 211/126.13; 211/133.2

(58) Field of Search ..... 211/94.01, 162, 211/181.1, 46, 48, 37, 126.13, 133.1, 133.2, 133.3, 133.5, 10–11; 248/175

(56) References Cited

U.S. PATENT DOCUMENTS

| | | | | |
|---|---|---|---|---|
| D. 333,489 | | 2/1993 | Stern et al. . | |
| 401,553 | | 4/1889 | Godfrey . | |
| 572,336 | * | 12/1896 | Dawson | 211/48 |
| 1,039,554 | | 9/1912 | Lindhorst . | |
| 1,781,991 | * | 11/1930 | Stover | 248/175 |
| 1,804,455 | * | 5/1931 | Bodine et al. | 211/50 |
| 2,096,349 | * | 10/1937 | Moxley | 248/175 |
| 2,456,845 | * | 12/1948 | Stine et al. | 248/175 |
| 2,551,157 | | 5/1951 | Price . | |
| 3,054,588 | * | 9/1962 | Ondrasik | 211/181.1 |
| 3,098,488 | * | 7/1963 | Schnelle | 211/46 |
| 3,159,280 | * | 12/1964 | Condon | 248/175 |
| 3,266,496 | * | 8/1966 | West et al. | 211/46 |
| 3,283,912 | * | 11/1966 | Cullen | 211/46 |
| 3,532,225 | * | 10/1970 | Reed | 211/181.1 |
| 3,899,082 | * | 8/1975 | Young et al. | 211/46 |
| 4,126,230 | | 11/1978 | Tyson et al. . | |
| 4,317,416 | | 3/1982 | Baum et al. . | |
| 4,323,291 | | 4/1982 | Ball . | |
| 4,458,585 | * | 7/1984 | Erbach | 211/181.1 |
| 4,570,275 | * | 2/1986 | Merriman | 248/175 |
| 4,693,381 | * | 9/1987 | Lodge | 211/94.01 |
| 4,709,891 | | 12/1987 | Barnett . | |
| 4,852,500 | | 8/1989 | Ryburg et al. . | |
| 4,869,378 | * | 9/1989 | Miller | 211/94.01 |
| 4,879,955 | | 11/1989 | Moll et al. . | |
| 4,884,513 | | 12/1989 | Newhouse et al. . | |

(List continued on next page.)

*Primary Examiner*—Daniel P. Stodola
*Assistant Examiner*—Jennifer E. Novosad
(74) *Attorney, Agent, or Firm*—Flynn, Thiel, Boutell & Tanis, P.C.

(57) ABSTRACT

A rail-mounted hanging file arrangement includes a generally horizontally elongated rail which is supported in upwardly spaced relationship from the worksurface so as to extend generally along but above the rear edge thereof. The rail defines therein a longitudinally elongated slot which opens forwardly of the rail, and a file hanging frame is releasably attached to the rail at substantially any position therealong so that the frame is carried entirely by the rail and projects rearwardly a small distance therefrom to permit conventional hanging type files to be stored just rearwardly of the rail adjacent the rear edge of the worksurface. The file hanging frame includes a pair of generally parallel side legs which are spaced so as to permit a plurality of hanging files to be suspended therebetween, and the hang tabs provided on opposite ends of the files can engage the side legs. These side legs of the file hanging frame at their front ends fixedly join to front legs which project downwardly and also slope inwardly in converging relationship with one another. The front legs at the lower ends thereof respectively join to securing legs of short extent which are insertable into the slot of the support rail to fixedly but releasably secure the frame to this support rail.

23 Claims, 4 Drawing Sheets

U.S. PATENT DOCUMENTS

| | | | | |
|---|---|---|---|---|
| 4,893,771 | * | 1/1990 | Kaneshiro | 248/175 |
| 4,938,442 | | 7/1990 | Mastrodicasa . | |
| 4,948,205 | | 8/1990 | Kelley . | |
| 4,974,913 | | 12/1990 | Vogt et al. . | |
| 4,993,785 | | 2/1991 | Dunand . | |
| 5,048,698 | | 9/1991 | Konrad . | |
| 5,057,039 | | 10/1991 | Persing et al. . | |
| 5,103,741 | | 4/1992 | Grund et al. . | |
| 5,117,985 | * | 6/1992 | Bluthardt et al. | 211/181.1 |
| 5,121,698 | | 6/1992 | Kelley . | |
| 5,127,529 | * | 7/1992 | Martinez | 211/181.1 |
| 5,429,252 | | 7/1995 | Liu . | |
| 5,486,042 | | 1/1996 | Heisler et al. . | |
| 5,765,792 | * | 6/1998 | Thomas | 248/175 |
| 5,934,489 | * | 8/1999 | Dusel et al. | 211/46 |
| 6,006,928 | * | 12/1999 | Parker | 211/94.01 |

* cited by examiner

RAIL-MOUNTED HANGING FILE ARRANGEMENT

FIELD OF THE INVENTION

This invention relates to a rail-mounted hanging file arrangement, particularly for use in an office environment.

BACKGROUND OF THE INVENTION

The modern office has become exceedingly crowded and cluttered because of the increasing amount of equipment utilized by an office worker, such as a computer and the like. At the same time the need to work with, handle and store large numbers of documents continues to significantly contribute to the overall clutter and crowdedness of the office. Numerous types of closed and opened storage tools, including a wide variety of types and sizes of tools adapted to be mounted on walls or enclosed drawers, have been developed in an effort to provide increased but accessible storage of documents and articles. Many of these tools or accessories, however, either require mounting on a wall or containment in a closed storage unit, or require that bulky or complex overhead storage structures be supported on and project upwardly from a worksurface or table top, and the latter greatly impact both the usability of the worksurface and the openness and visibility afforded a person working at the worksurface.

In recognition of the disadvantages associated with conventional structures of the type summarized above, the present invention relates to a rail-mounted hanging file arrangement which, in a preferred embodiment, can be associated with a rail which readily mounts to a worksurface so as to project along the worksurface in upwardly space relation adjacent a rear edge thereof, with a hanging-file frame being readily attachable to the rail to provide convenient storage for at least a limited number of conventional hanging-type files closely adjacent the worksurface so as to provide convenient access thereto, without requiring cumbersome and complex structures which mount on and obstruct the worksurface.

In the rail-mounted file-hanging arrangement of this invention, a generally horizontally elongated rail is supported in upwardly spaced relationship from the worksurface so as to extend generally along but above the rear edge thereof. The rail defines therein a longitudinally elongated slot which opens generally forwardly of the rail. A file-hanging frame is releasably and easily attached to the rail at substantially any position therealong so that the frame is carried entirely by the rail and projects rearwardly a small distance therefrom to permit conventional hanging-type files to be stored just rearwardly of the rail adjacent the rear edge of the worksurface. The frame arrangement includes a pair of generally parallel side legs which are spaced upwardly from and project rearwardly relative to the support rail. The spacing between the side legs is such as to permit a plurality of hanging files to be suspended therebetween. The hang tabs provided on opposite ends of the files engage the side legs. At their front ends the side legs fixedly join to front legs which project downwardly and also preferably slope inwardly in converging relationship to one another. The front legs at their lower ends respectively join to rearwardly cantilevered securing legs of short extent, the latter being insertable into the slot of the support rail to fixedly but releasably secure the frame to the support rail. The frame is preferably a one-piece structure, such as by being formed in one piece from an elongate metal rod, and in the preferred embodiment includes a generally horizontally elongate rear leg joined between rear ends of the side legs.

The hanging frame arrangement of this invention can be economically manufactured so as to provide a very compact but lightweight structure. The resulting hanging frame arrangement can be readily mounted on or removed from the support rail, and can be positioned substantially at any desired location longitudinally along the support rail to facilitate convenient use thereof. The hanging frame arrangement, when mounted on the rail, permits several hanging-type file folders to be suspended downwardly from the frame closely adjacent the rear of the support rail, and generally within space adjacent a wall if the worksurface is mounted adjacent a wall. The frame also positions the folders such that they are generally positioned above the worksurface and thus are readily visible and accessible to a person using the worksurface. Several such frames can also be easily mounted longitudinally along the support rail if desired.

While the support rail in a preferred embodiment is mounted on one or more stanchions which are secured to and project upwardly from the worksurface adjacent a rear edge thereof, it will be recognized that the support rail can also be cantilevered forwardly from an adjacent wall for disposition above an adjacent worksurface if desired.

Other objects and purposes of the invention, as well as structural and functional variations thereof, will be apparent to persons familiar with this type of working environment upon reading the following specification and inspecting the accompanying drawings.

Figure 1:
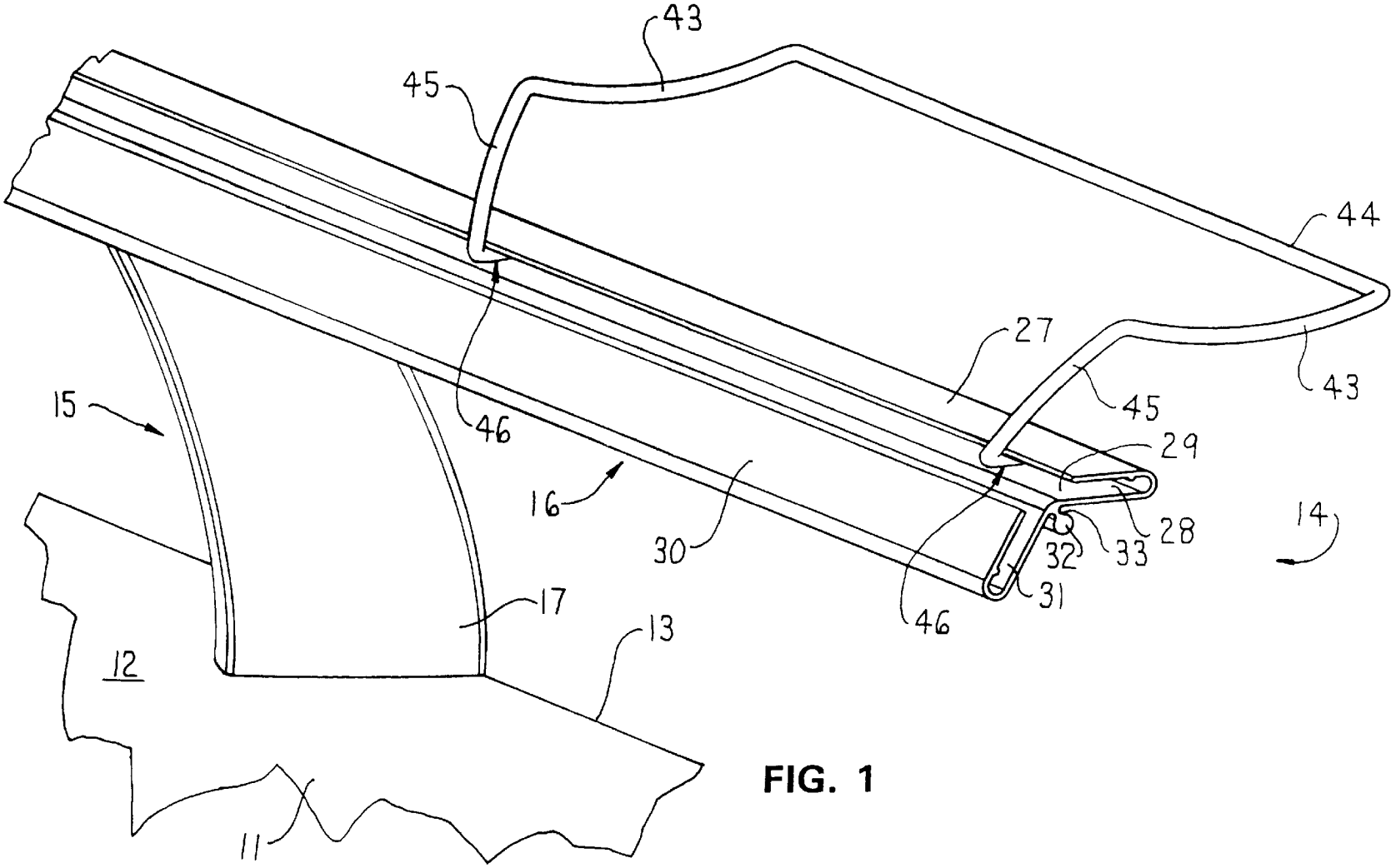
FIG. 1 is a perspective view which illustrates a fragment of a horizontally enlarged worksurface having a rail structure mounted in upwardly space relation from a rear edge thereof, and which in addition illustrates a hanging file arrangement according to the present invention mounted on the rail structure.

Certain terminology will be used in the following description for convenience in reference only, and will not be limiting. For example, the words "upwardly", "downwardly", "rightwardly", and "leftwardly" will refer to directions in the drawings to which reference is made. The word "front" will be used to refer to the edge of the worksurface adjacent the worker and "rear" will refer to the edge which is normally remote from the worker. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to the drawings, there is illustrated a part of a horizontally enlarged worksurface 11, such as a table top or a worksurface of the type which mounts on a wall panel. The worksurface 11 defines thereon an enlarged and generally horizontally planar upper surface 12, with the worksurface terminating in a longitudinally extending rear edge 13 which is remote from the side of the worksurface which is normally closest to the worker. The worksurface 11 is illustrated as mounting a rail arrangement 14 thereon adjacent the rear edge 13. The rail arrangement 14 includes one or more support arms or stanchions 15 which mount on and project upwardly from the worksurface 11 and support a generally horizontally elongate support rail 16 adjacent the upper end thereof. The rail 16 is disposed in upwardly spaced relation from the worksurface and extends generally longitudinally parallel to the worksurface rear edge 13.

The support arm or stanchion 15, in the illustrated embodiment, includes a main tower or body part 17 which bears on the upper surface 12 of the worksurface and projects upwardly therefrom so as to terminate in top support plates which, in the illustrated embodiment include a front plate 18A which angles downwardly and a rear plate 18B which projects generally horizontally. The tower part 17, adjacent the upper end thereof, also has a guide tube structure 19 fixed thereto and extending horizontally transversely thereof, which guide structure defines an opening 20 extending therethrough. This latter opening 20 extends parallel with the elongate direction of the rail and opens upwardly through a longitudinally elongate access slot 21 which opens upwardly between the support plates 18A and 18B.

The main tower part 17 is secured to the worksurface by an L-shape clamp part 22 having a vertical leg 23 which overlies the rear of the tower part 17. The rear surface of the tower part 17 has a pair of pins 26 projecting therefrom, which pins are insertable through slots formed in the vertical leg 23 so as fixedly secure the tower part 17 and clamp part 22 together.

L-shape clamp part 22 also has a lower leg 24 which is horizontally cantilevered forwardly so as to project under the worksurface 11, and this latter leg 24 mounts thereon a manually adjustable clamping member 25, such as a threaded member which can be rotated into tightening engagement with the undersurface of the worksurface 11. When so tightened, the stanchion or support arm is fixedly attached to the worksurface so as to project upwardly therefrom in the vicinity of the rear edge, without creating any significant rearward protrusion at the rear edge.

The rail 16 in the illustrated and preferred embodiment is of a generally inverted V-shape cross-section and includes a top or rear leg 27 which extends generally horizontally. The leg 27 is of a U or channel-shaped cross section and defines therein a slot 28 which extends throughout the longitudinal length of the rail. This slot 28 is closed at its rearward end, and at its forward end terminates at a mouth 29 which permits access to the slot.

The rail 16 also includes a front or lower leg 30 which slopes downwardly as it projects forwardly from its intersection with the top leg 27. The front leg 30 also is of a U or channel-shaped cross section and has a slot 31 formed therein and extending longitudinally throughout the length of the rail. The lower front end of the slot 31 is closed, and the opposite end communicates with and is accessible through the mouth 29.

Support rail 16 also has a mounting rod 32 fixed thereto and extending longitudinally throughout the length thereof. This mounting rod 32 is disposed under and generally inside the apex of the V-shape, and is fixedly secured to the bottom wall of the channel parts by an elongate rib 33 which is of smaller cross-section than the mounting rod 32. The mounting rod 32 has a cross-section which generally corresponds to the cross-section of the opening 20, which rod and opening are circular in the preferred embodiment, whereby the mounting rod 32 can be snugly but slidably inserted through the horizontal guide 19 so as to be supported therein, whereupon the rib 33 projects through the access slot 21 so that the lower walls of the front and rear rail legs 30 and 27 are thus positioned substantially for respective engagement with the front and rear support plates 18A and 18B.

The rail 16 in the illustrated embodiment is formed in one piece, such as by being suitably formed from thin metal plate (such as aluminum) which is appropriately deformed to define a hollow V-shaped wall which respectively defines the bottom walls of the front and rear legs, with these bottom walls then being appropriately bent through angles of about 180° so as to terminate in top walls which terminate short of one another so as to define the mouth 29 therebetween, which mount in turn communicates with the slots defined between the spaced top and bottom walls of the respective rail legs.

The overall construction of the rail arrangement 14 is described in greater detail in copending application Ser. No. 09/304,162, filed concurrently herewith, entitled "Support Rail Assembly for Office Accessories" , the disclosure of which is in its entirety is incorporated herein by reference.

According to the present invention, there is provided a hanging file arrangement 41 which is adapted to be detachably but rigidly supported, in its entirety, on the support rail 16 so as to permit a plurality of conventional hanging-type files or folders 51 to be suspended therefrom.

The hanging file arrangement 41 is defined by a generally open frame which, when viewed from either the front or the top, is of a generally U-shaped configuration. This file frame 41 is of a generally rigid and one-piece construction and includes a pair of generally parallel and sidewardly spaced side frame elements or legs 43 which, at their rearward ends, are rigidly joined to opposite ends of an elongate back frame element or leg 44. This back frame element 44 extends generally horizontally in substantially perpendicular relationship to the side legs 43, and has a length which slightly exceeds the length of the file folders 51 so that the latter can be positioned so as to extend in the space between the parallel side legs 43.

The front ends of the frame side legs 43 are in turn fixedly joined to front frame elements or legs 45 which project vertically downwardly. The front legs have their lower ends in turn fixedly secured to short securing legs 46 which are cantilevered horizontally rearwardly. The legs 46 are, in the illustrated embodiment, generally L-shaped so that a front leg part 47 projects horizontally rearwardly and is bent 90° to define a horizontal rear leg part 48 that terminates in a free end 49. Securing legs 46 are sized so as to snugly but removably project into the horizontal slot 28 defined by the top rail leg 27 to thus secure the hanging file frame 41 to the support rail 16.

The front legs 45 of the frame 41 are preferably angled inwardly relative to the vertical so as to converge toward one another as they project downwardly, and also are preferably slightly angled forwardly as they project downwardly, whereupon the lower ends of the front legs 45 are thus disposed generally within the mouth 29 of the support rail when the securing legs 46 are positioned within the slot 28. When in this latter position the front legs 45, adjacent their juncture with the securing legs 46, will typically at least substantially abut the front edge of the top wall of the top rail leg.

The side legs 43 of the frame are preferably bowed or arched downwardly to define an upwardly-opening concave shape as the side legs extend between the front and rear ends thereof so as to provide a shallow depression whereby the side legs, when engaged with conventional L-shaped hanging tabs 52 associated with folders 51, will positively retain the folders in position and prevent them from accidentally slipping off the frame.

The one-piece frame 41 in the illustrated and preferred embodiment is formed by being bent from a one-piece elongate metal rod whereupon the junctures between all of the various legs are thus bent and define rounded corners so as to improve the overall appearance of the frame and to eliminate the presence of sharp corners. It will be appreciated, however, that the frame can also be formed from multiple individual pieces which are appropriately fixed together, such as by welding or other suitable bonding. The metal rod is preferably provided with an appropriate coating thereon, such as a plastic polymer. Alternately, if appropriate strength requirements can be met, then the frame can also be formed of engineered plastics.

Figure 2:
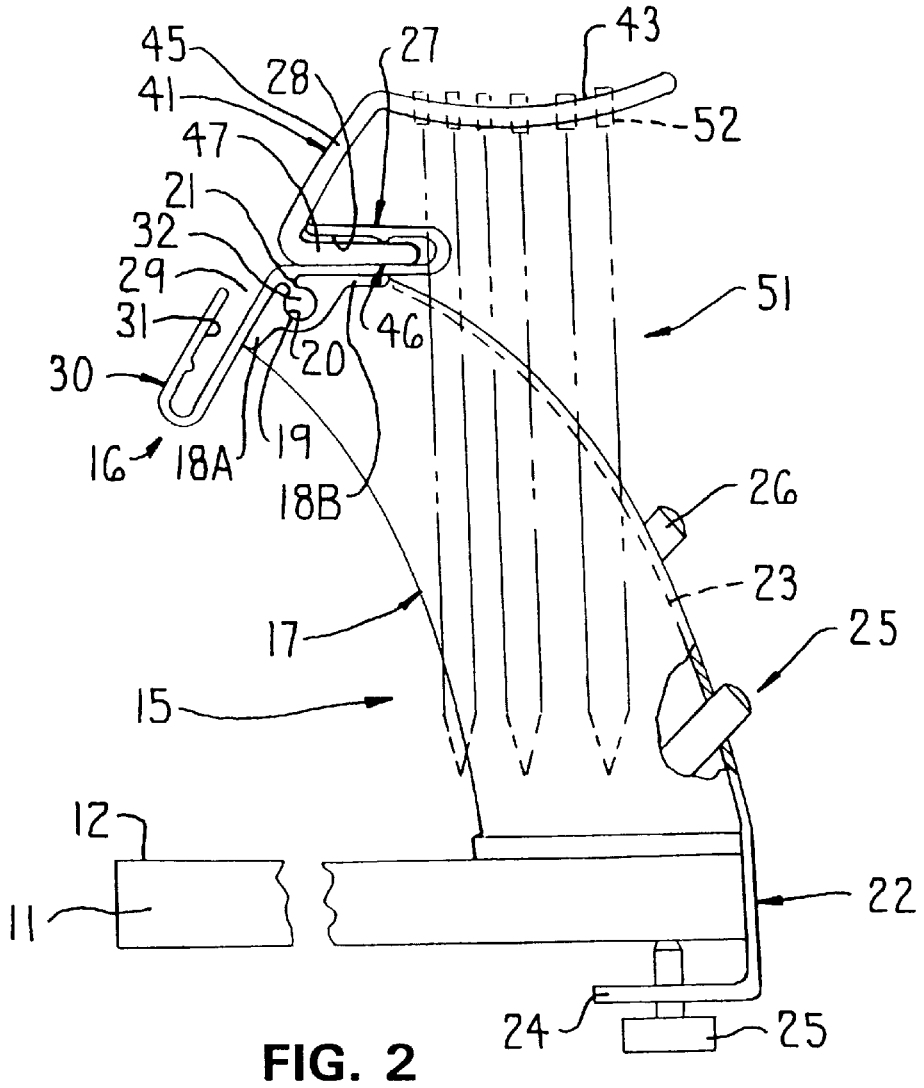
FIG. 2 is an end elevational view showing the hanging file arrangement mounted on the elongate rail and additionally showing the support rail mounted on the worksurface.
Figure 3:
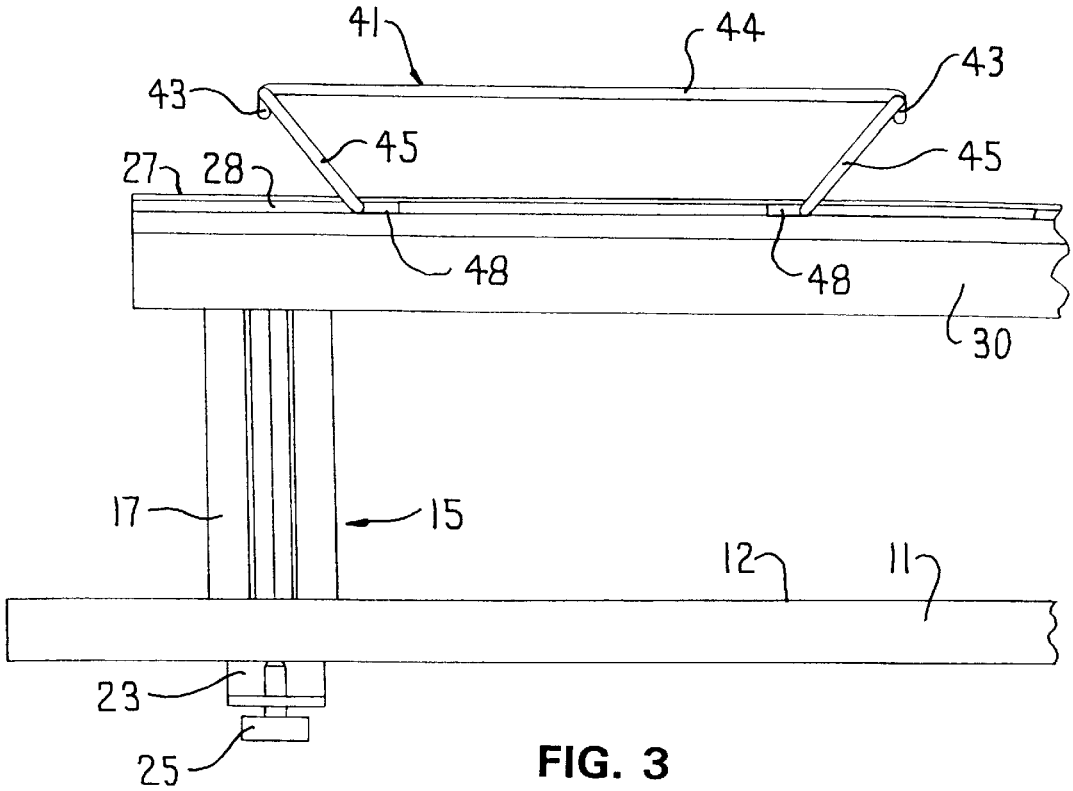
FIG. 3 is a front view showing the support rail mounted on the worksurface and the hanging file arrangement mounted on the support rail.
Figure 4:
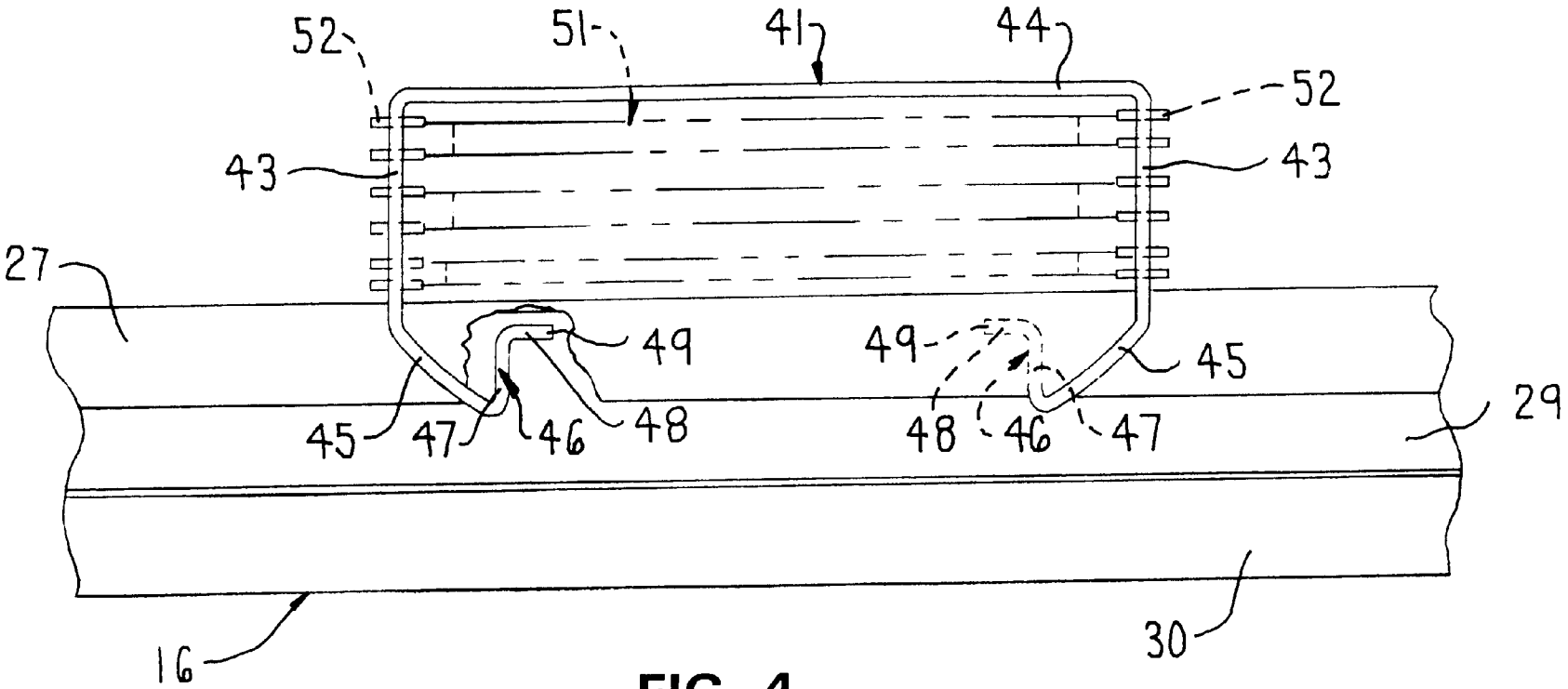
FIG. 4 is a top view of the hanging file arrangement as mounted on the support rail.

With the overall arrangements of the present invention, substantially as illustrated by FIGS. 1–4, the hanging file arrangement provides a generally rectangular space which is disposed directly adjacent but rearwardly of the support rail 16 and which is also disposed upwardly of the worksurface 11 so that a small plurality of conventional hanging file folders 51 can thus be supported on the frame 41 directly behind the support rail, thereby permitting efficient utilization of space which often times is not effectively utilized. In fact, even when the worksurface 11 is positioned adjacent a wall, typically a small amount of space exists between the rail and the wall so as to permit utilization of the hanging file arrangement of this invention. Further, the file folders supported on the frame 41 are both readily visible and accessible, and thus are particularly desirable for files containing documents which must be frequently and conveniently accessed. At the same time, the file folders permit documents to be readily stored when not in use, and thus permit minimization of clutter on the worksurface.

With the hanging file arrangement 41 of this invention, a worker can readily attach the file frame onto the support rail at any location therealong merely by slidably inserting the securing legs 46 into the slot 28 of the top rail leg 27, thus effectively creating a clamping of the legs within the slot so that the overall frame 41 is, in its entirety, supported in an upward and rearward cantilevered fashion from the support rail 16. When the file folders 51 are supported on the side legs 43 of the frame 41 and thus impose a load thereon, this load is imposed downwardly on the frame rearwardly of the support rail, and this load in turn is resisted by the short L-shaped securing legs 46 which are confined within the slot 28 of the top rail leg 27.

Conversely, when use of the hanging file arrangement 41 is not desired, then the file folders 51 can be removed and stored, and the one-piece frame 41 can likewise be readily detached from the support rail 16.

While the V-shape support rail 16 is a preferred construction that permits numerous other types of tools to be mounted thereon, it will nevertheless be appreciated that the V-shape configuration is not required for use with the hanging file arrangement 41 of this invention. In fact, any conventional elongate rail having an appropriate slot or groove arrangement, such as a generally C-shape rail arrangement, will function to support the hanging file arrangement of this invention.

It will be further appreciated that the support rail can be secured to and cantilevered horizontally outwardly from an adjacent wall, rather than upwardly from the worksurface, if desired. In such case the rail would again be secured to support arms which, rather than securing to the worksurface, would instead project horizontally for securement to the adjacent wall. This latter type arrangement is disclosed in aforementioned copending application Ser. No. 09/304162. Other suitable mountings for the support rail 16 could also be provided.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A hanging file arrangement for use with a worksurface having an enlarged upper surface, said hanging file arrangement comprising:

an elongate support rail adapted to be stationarily positioned above the worksurface adjacent and extending generally parallel to a longitudinally extending edge of the worksurface, said rail defining therein a slot having a mouth which opens generally forwardly of the rail, said slot extending longitudinally along the rail; and a file-hanging frame releasably supported on said rail to enable a hanging-type file folder to be suspended from the frame adjacent but rearwardly of the rail;

said file-hanging frame including a pair of generally horizontally projecting side legs which are sidewardly spaced apart in upwardly spaced relation from the support rail and which project generally transversely relative to the longitudinal direction of the support rail;

said frame also including a pair of front legs which at upper ends are joined to front ends of respective said side legs, said front legs at lower ends being disposed adjacent the mouth of said slot; and said frame further including a pair of short securing legs joined to the lower ends of the respective said front legs and cantilevered horizontally rearwardly from the lower ends of the front legs so as to project into said slot to secure said frame to said support rail.

2. An arrangement according to claim 1, wherein said frame includes a horizontally elongate cross rail which extends between and is rigidly joined to said pair of side legs.

3. An arrangement according to claim 2, wherein said cross leg is joined between rearward ends of said side legs so that said frame has a generally U-shape configuration when viewed both from above and from the front.

4. An arrangement according to claim 3, wherein said side legs, along the length thereof, have a shallow upwardly-opening concave configuration for maintaining engagement with hanging tabs of suspended file folders.

5. An arrangement according to claim 1, wherein said support rail is secured to an upper end of an upright support arm which projects downwardly and is supportingly engaged with the worksurface adjacent a rear edge thereof, whereby said support rail is disposed in upwardly spaced relation from the upper surface of the worksurface in the vicinity of the rear edge thereof.

6. An arrangement according to claim 1, wherein said front legs converge inwardly toward one another as they project downwardly from said side legs.

7. An arrangement according to claim 1, wherein said front legs slope forwardly as they project downwardly from said side legs.

8. An arrangement according to claim 1, wherein said side legs, along the length thereof, have a shallow upwardly-opening concave configuration for maintaining engagement with hanging tabs of suspended file folders.

9. An arrangement according to claim 1, wherein the frame is formed from an elongate rod so as to define a one-piece monolithic member.

10. An arrangement according to claim 1, wherein the securing legs are L-shaped.

11. An arrangement according to claim 1, wherein said frame is supported solely by said rail.

12. An arrangement comprising:

a worksurface having longitudinally extending front and rear edges and defining thereon an enlarged and substantially horizontal upper surface;

a support rail assembly mounted on said worksurface adjacent the rear edge thereof and including an elongate support rail which is stationarily disposed adjacent but in upwardly spaced relation relative to said rear edge so as to extend generally parallel thereto, and an upright support extending vertically between said worksurface and said support rail for securing the support rail relative to the worksurface;

said support rail defining therein a groove which extends longitudinally therealong, said groove opening transversely relative to the lengthwise extent of the support rail so as to terminate at a mouth; and a support frame mounted on said support rail for suspended support of at least one hanging file thereon, said support frame being defined by an elongate cross element which is disposed rearwardly of said support rail and extends substantially parallel to said support rail and which at opposite ends is rigidly joined to a pair of side elements which extend generally perpendicularly relative to the cross element, said side elements defining thereon elongate portions for accommodating hangers associated with suspended file folders, said side elements at ends thereof terminating in short cantilevered projections which project into and seat within said groove so as to stably but removably support said frame on said support rail, whereby file folders supported on said side elements can be suspended downwardly behind said support rail.

13. An arrangement according to claim 12, wherein said cross element and said side elements define a generally U-shape configuration when viewed from above.

14. An arrangement according to claim 12, wherein said side elements include elongate front portions which project vertically downwardly and terminate in said cantilevered projections so that the said elongate portions of the side elements are disposed vertically upwardly and rearwardly relative to the support rail.

15. An arrangement according to claim 14, wherein the groove in said support rail opens transversely in a direction which is generally toward the front edge of the worksurface, and wherein the cantilevered projections of the side elements are formed at lower ends of the front portions and project rearwardly of the lower ends of the front legs for insertion into said groove.

16. An arrangement according to claim 14, wherein said frame has a generally inverted U-shape configuration when viewed from a front side thereof.

17. A hanging file arrangement for use with a worksurface having an enlarged upper surface, said hanging file arrangement comprising:

a support structure including an elongate support rail stationarily positioned on the worksurface, the support rail being positioned in close proximity to and extending generally parallel with one elongate edge of said worksurface, said support rail having a slot which extends longitudinally thereof in generally parallel relation with said one edge and which opens transversely of the rail;

a file-hanging frame releasably supported on said support rail to enable hanging-type file folders to be suspended from the frame adjacent and outwardly from said support rail;

said file-hanging frame including a pair of sidewardly spaced-apart and generally horizontally projecting parallel side legs which are disposed above said support rail and which project transversely outwardly away from said support rail, whereby hanging file folders are supported on and extend between said side legs and are suspended downward at a location adjacent said one edge of said worksurface;

said frame further including a cross leg which extends transversely between and is joined to said pair of side legs adjacent rearward ends thereof;

said frame also including a pair of front legs which at upper ends thereof are joined to front ends of the respective side legs, said front legs projecting transversely downwardly relative to said side legs and having lower segments which project into and are releasably secured in said slot of said support rail so that said frame is supported solely by the engagement of the lower segments of the front legs in the slot.

18. An arrangement according to claim 17, wherein said cross leg is rigidly joined to said pair of side legs.

19. An arrangement according to claim 18, wherein said cross leg is joined to the rearward ends of said side legs so that said frame has a generally U-shape configuration when viewed both from above and from the front.

20. An arrangement according to claim 19, wherein said side legs, along the length thereof, have a shallow upwardly-opening concave configuration for maintaining engagement with hanging tabs of suspended file folders.

21. An arrangement according to claim 17, wherein said file-hanging frame enables a hanging-type file folder to be suspended from said frame so as to be spaced horizontally from said support structure.

22. A hanging file arrangement for use with a worksurface having an enlarged upper surface, said hanging file arrangement comprising:

a support structure adapted to be stationarily positioned on the worksurface, said support structure including an elongated slot defined by upper and lower walls which opens forwardly of said support structure;

a file-hanging frame releasably supported on said support structure to enable a hanging-type file folder to be suspended from the frame adjacent said support structure;

said file-hanging frame including a pair of sidewardly spaced-apart and generally horizontally projecting side legs which are disposed in upwardly spaced relation from said support structure;

said frame also including a pair of front legs which at upper ends thereof are joined to front ends of the respective side legs, said front legs projecting transversely relative to said side legs and having lower segments, said slot receiving the lower segments of each of said front legs which project rearwardly directly into said slot so as to each be sandwiched between said upper and lower walls.

23. An arrangement according to claim 22, wherein said lower segments of said front legs are horizontally spaced from each other when received in said slot of said support structure.

* * * * *